United States Patent [19]

Ditcher

[11] Patent Number: 4,618,464

[45] Date of Patent: Oct. 21, 1986

[54] PRECAST CONCRETE MANHOLE ADJUSTABLE BOLT SLOT FOR SECURING CAST IRON FRAME AND COVER AND METHOD FOR CASTING SAME

[75] Inventor: Jack Ditcher, Langhorne, Pa.

[73] Assignee: A-Lok Products, Incorporated, Tullytown, Pa.

[21] Appl. No.: 632,392

[22] Filed: Jul. 19, 1984 (Under 37 CFR 1.47)

[51] Int. Cl.[4] ..... B28B 5/00; B28B 7/00

[52] U.S. Cl. ..... 264/35; 249/88; 249/11; 249/122; 249/144; 264/138; 264/274; 264/333; 264/334

[58] Field of Search ..... 52/709, 711, 710, 19-21; 249/83, 88, 91, 122, 144; 264/31, 32, 256, 333, 271, 275, 279, 138, 334, 35, 274

[56] References Cited

U.S. PATENT DOCUMENTS

| | | | |
|---|---|---|---|
| 960,625 | 6/1910 | Cowles | 52/711 |
| 3,004,636 | 10/1961 | Shane | 52/710 |
| 3,095,672 | 7/1963 | DiTullio et al. | 52/710 |
| 3,121,978 | 2/1964 | Reiland | 52/707 |
| 3,561,307 | 2/1971 | Mortensen | 52/707 |
| 3,623,353 | 11/1971 | Dinerman | 52/707 |
| 3,926,330 | 12/1975 | Deming et al. | 174/65 R |
| 3,964,219 | 6/1976 | Hala | 52/707 |
| 4,130,977 | 12/1978 | Taylor et al. | 52/711 |
| 4,141,190 | 2/1979 | Shimada | 52/711 |
| 4,366,343 | 12/1982 | Slater et al. | 174/65 R |
| 4,389,535 | 6/1983 | Slater et al. | 174/65 R |
| 4,419,537 | 12/1983 | Leep et al. | 174/65 R |

*Primary Examiner*—Willard E. Hoag
*Attorney, Agent, or Firm*—Louis Weinstein

[57] ABSTRACT

A top concrete section for a manhole assembly is cast with a plurality of bolt slot inserts each insert having a substantially inverted T-shaped hollow interior for slideably receiving a nut which may be moved to any desired position along the base of the insert for threadedly engaging a threaded rod employed to rigidly secure a cast iron cover frame to the top section.

The method for casting a manhole top section comprises the steps of releasably mounting each insert within the mould assembly by means of a retaining slide which itself is slideably received within a pair of holding brackets provided on each of the inner and outer mould members, the insert being substantially fully closed on all sides thereof and having a top surface formed of a thin web which is easily fractured or cut away after the top manhole section is cast. The fully enclosed insert prevents any concrete from entering into the interior thereof.

The nut may be moved along the length of the insert base in order to bring it into alignment with bolt hole centers in the cast iron frame.

13 Claims, 18 Drawing Figures

PRECAST CONCRETE MANHOLE ADJUSTABLE BOLT SLOT FOR SECURING CAST IRON FRAME AND COVER AND METHOD FOR CASTING SAME

FIELD OF THE INVENTION

The present invention relates to manhole assemblies and more particularly to a novel manhole top section having elongated inserts for slideably receiving threaded nuts or the like enabling the threaded nuts to easily be brought into precise alignment with the bolt hole centers of a cast iron frame to be secured thereto, and to a method for producing such top sections.

BACKGROUND OF THE INVENTION

Precast concrete sanitary manholes are typically comprised of a manhole base, one or more riser sections and top section. The inner diameter of concrete manholes is typically 48 inches or greater. The inner diameter is reduced by use of the top section typically to a standard 24 inch or 30 inch diameter manhole cover normally encountered on city streets and highways. The top concrete section of a manhole is typically a reducing cone or a reducing slab having a wall with a minimum eight inch thickness at the top for load bearing of the cast iron frame which is of a thickness and strength sufficient to accept traffic loading.

Cast iron frames are typically secured to the concrete manhole structure either by being set in a bed of mortar arranged between the top of the top section and the cast iron frame or more frequently are secured to the concrete structure through the use of from 2 to 4 mounting bolts, each typically of a $\frac{3}{4}$ inch diameter. Bolts or all-thread rods are always used to secure the cast iron frame to the manhole top section when the manhole is in a flood area necessitating a water-tight mounting.

The standard practice is to set threaded bolt inserts in the top manhole section when it is being cast. The inserts must be set upon exact centers to match the bolt hole centers in the particular cast iron frame. This requires a very precise positioning and holding assembly. In addition, the bolt centers in the cast iron frames are never constant and vary according to the type of cover employed and to the personal preference of the engineers designing the system. As a result, each top concrete manhole section must be manufactured and inventoried for the particular job, requiring an unnecessarily large inventory of both finished sections and mold assemblies.

BRIEF DESCRIPTION OF THE INVENTION

The present invention is characterized by comprising apparatus and method for providing a substantially universal manhole top section adapted to accomodate substantially any bolt hole center arrangement provided in the cast iron frame to be mounted thereto, allowing the top manhole sections to be standarized and shipped to any job, thus avoiding the need for customizing the top sections.

The apparatus of the present invention comprises an elongated plastic insert and removable holding means for releasably positioning the insert in the proper alignment within the top manhole section mold assembly.

The insert is preferably formed of a suitable plastic material having a substantially T-shaped hollow interior. One end of the insert is open, to facilitate molding, and is closed by a snap-on end cap. The top surface of the insert is formed by a thin web which maintains the spacing of the insert side walls across the top of the insert during the casting of the manhole top section and which is easily fractured or cut to facilitate insertion of a threaded bolt or other like fastener.

In the preferred method, a polygonal shaped nut is initially placed within the base of the insert, the end cap is snapped on to the insert and the insert is slideably moved into engagement with a retaining handle assembly in its proper position within the mold assembly.

Thereafter, the cementitious material is poured into the mold and surrounds the insert. After the cementitious material has cured, the slideable member is removed and the cast top manhole section is removed from the inner and outer mold members. The insert is firmly held in place by the cured concrete.

The aforementioned thin web is fractured to insert the threaded member into the nut previously placed within the insert. The cast iron frame is set upon the top section with the threaded member in alignment with its associated bolt hole. The nut is tightened down against the cast iron frame, rigidly securing the cast iron frame to the top section in a water tight manner for example. The radially aligned inserts permit the nut slideably arranged therein to be moved either inwardly or outwardly along an imaginary radius to facilitate alignment of the nut and hence threaded bolt with an associated bolt hole in the cast iron frame, said inserts providing a universal top manhole section capable of having standard 24 inch or 30 inch diameter cast iron frames mounted thereto, for example.

OBJECTS OF THE INVENTION AND BRIEF DESCRIPTION OF THE FIGURES

It is therefore one object of the present invention to provide a novel insert for use in top manhole sections to facilitate securement of cast iron frames of a variety of sizes and/or bolt hole centers to the top section.

Still another object of the present invention is to provide a novel method, including apparatus for performing same, in which plastic inserts are easily and readily molded into a cast top manhole section to facilitate mounting of cast iron frames to the top section which frames may be accomodated by said inserts regardless of the arrangement of bolt hole centers thereon.

Still another object of the present invention is to provide a novel insert for use in molding a universal top manhole section capable of receiving cast iron frames having a variety of bolt hole centers and/or being of different diameters.

The above as well as other objects of the present invention will become apparent when reading the accompanying description and drawings in which.

Figure 3:
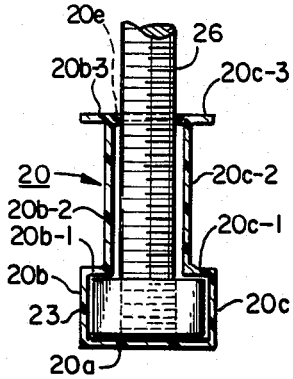
FIG. 3 shows an elevational detailed view, partially sectionalized, of an insert employed in the assembly of FIG. 1 showing the nut and threaded member assembled therein.
Figure 3A:
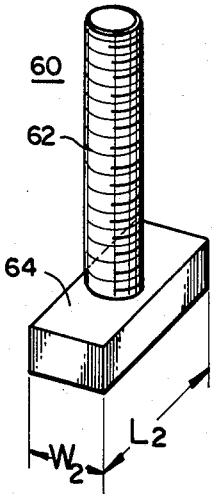

FIG. 3*a* is a perspective view of an alternative threaded member which may be used with the insert of FIG. 3.

Figure 4A:
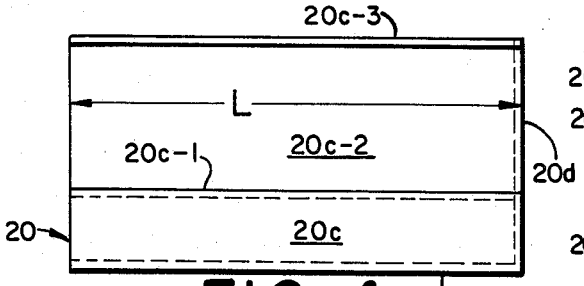
Figure 4B:
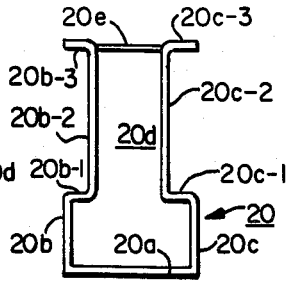
Figure 4C:
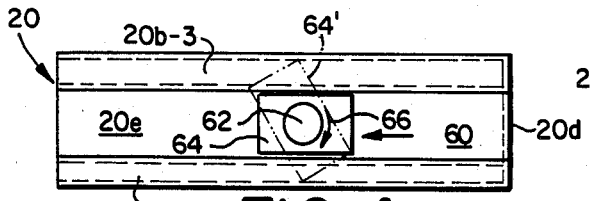

FIGS. 4*a*, 4*b* and 4*c* show side, end and top views respectively of the bolt slot insert of FIG. 3.

Figure 5D:
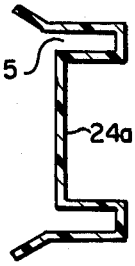
Figure 5C:
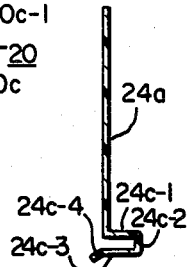
Figure 5:
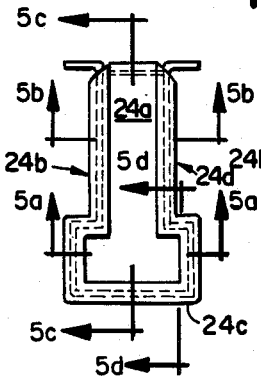
Figure 5A:
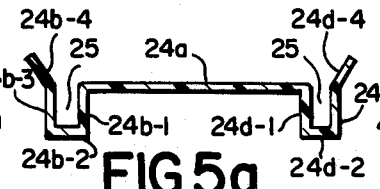

FIG. 5 shows an elevational view of an end cap which is snapped to the open end of the bolt slot insert of FIGS. 4*a* through 4*c*.

FIGS. 5*a* through 5*d* show sectional views of the end cap of FIG. 5 looking in a direction of arrows A-A[1]; B-B[1]; C-C[1] and D-D[1].

Figure 6A:
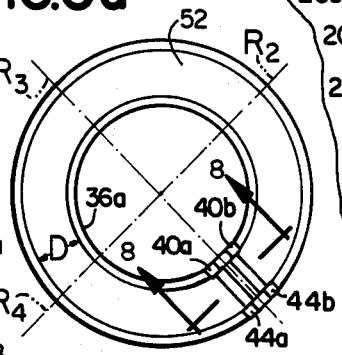
Figure 6:
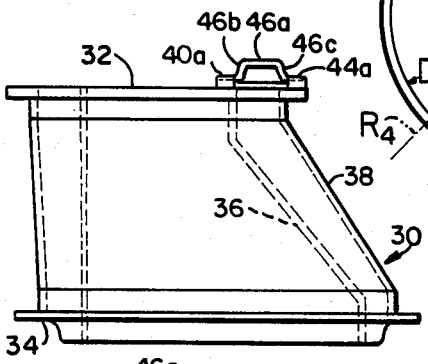
Figure 5B:
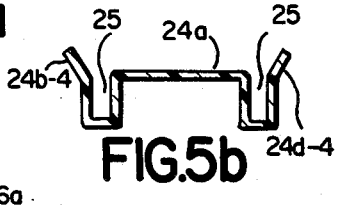

FIG. 6 shows an elevational view of a moulding assembly for forming eccentric cone-shaped top manhole sections.

FIG. 6*a* is a top plan view of the mold assembly of FIG. 6.

Figure 7A:
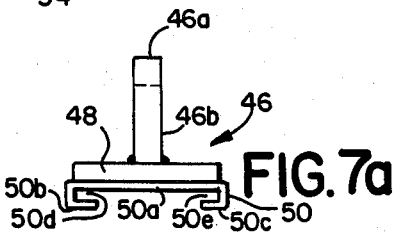
Figure 7:
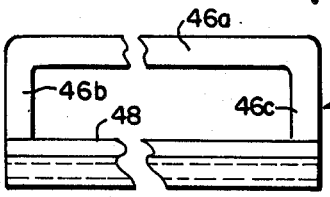

FIGS. 7 and 7*a* show side and end views respectively of the retaining handle employed for positioning and supporting an insert during the casting operation for forming a manhole top section.

Figure 8:
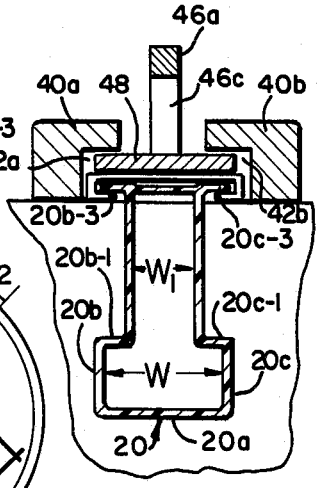

FIG. 8 shows a detailed sectional view of one insert showing the manner in which the slideable positioning and holding handle of FIGS. 7 and 7*a* maintains the insert in proper alignment during the casting operation.

DETAILED DESCRIPTION OF THE INVENTION

As is conventional in manhole assemblies, such assemblies are typically comprised of a manhole base (not shown), a riser section (not shown) and a top section, the base being provided with openings for receiving incoming and outcoming conduits and the riser and top sections being selected to provide the appropriate spacing distance between the manhole cover, which is typically at street level, and the manhole base.

The manhole base typically has an interior diameter of the order of 48 inches, as does the riser section. Since the manhole cover typically has a diameter of the order of 18 to 24 inches, the top section typically has an eccentric coneshaped configuration for reducing the diameter of the manhole assembly to receive the manhole cover.

Figure 1:
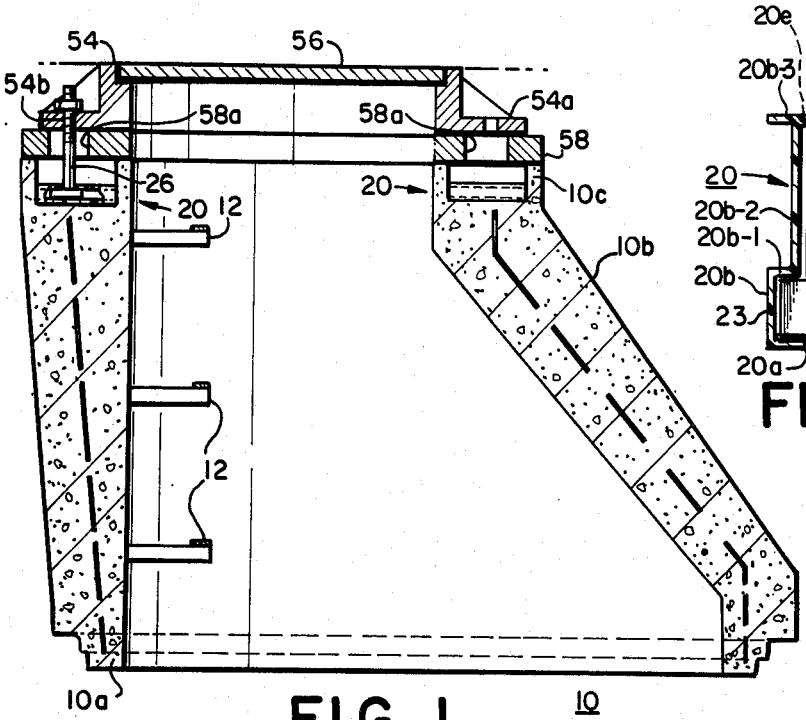
FIG. 1 shows a sectionalized elevational view of a top manhole section supporting a cast iron frame and embodying the insert of the present invention.
Figure 2:
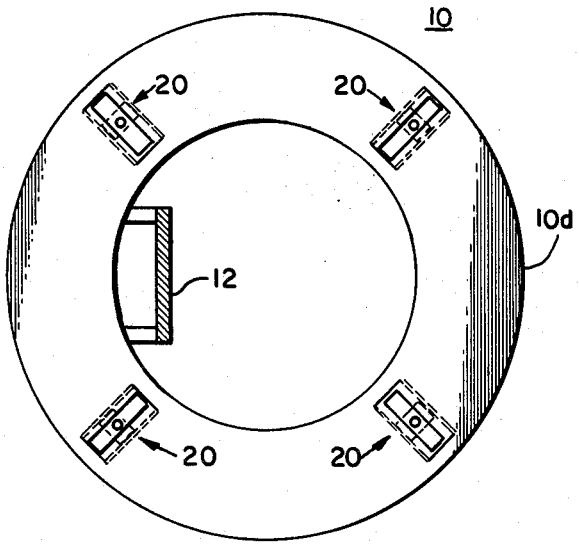
FIG. 2 shows a top plan view of the top surface of the manhole top section shown in FIG. 1 with the cast iron frame and adjustment ring removed.

Noting specifically FIGS. 1 and 2 there is shown there in a manhole top section 10 having a bottom portion 10*a* for resting upon and interfitting with the top surface of a riser section, not shown. The side wall has a circular cross-section and a conical shaped section 10*b* which tapers to a top cylindrical portion 10*c* of reduced diameter as compared with the bottom portion 10*a* of larger diameter. U-shaped inserts 12 are arranged along the interior vertical wall and collectively form a ladder to permit workmen to climb into and out of the manhole.

The top of the top section 10 terminates in an annular surface 10*d* which is substantially planar and is provided with a plurality of inserts 20 cast into the concrete manhole top section 10. One such insert is shown in enlarged detailed fashion in FIG. 3 and in the top, side and end views as shown in FIGS. 4*c*, 4*a* and 4*b*. The insert 20 has a base portion 20*a*. A pair of upwardly directed sides 20*b* and 20*c* integral with base 20*a* are bent inwardly at 20*b*-1 and 20*c*-1, upwardly at 20*b*-2 and 20*c*-2 and then outwardly to form flanges 20*b*-3 and 20*c*-3 as shown best in FIGS. 3 and 4*b*. The inwardly directed portions 20*b*-1 and 20*c*-1 define shoulders for holding a nut 23 within the interior of insert 20. Side wall portions 20*b*-2 and 20*c*-2 define the passageway for insertion and/or removal of a threaded rod 26. Outwardly directed flanges 20*b*-3 and 20*c*-3 serve as the means for supporting and positioning the inserts 20 during the casting operation by holding means to be more fully described in connection with FIGS. 7 and 7*a*.

Insert 20 has an end wall 20*d* sealing for example the right hand end of insert 20 as shown in FIG. 4*a*.

The top of the insert 20 is provided with a thin web 20*e* integrally joined to the side wall portions 20*b*-2 and 20*c*-2 adjacent the outwardly directed flanges 20*b*-3 and 20*c*-3, respectively. The insert 20 is completely sealed on all sides through the use of an end cap 24 having a substantially T-shaped periphery conforming to the T-shaped interior of insert 20. The end cap 24 comprises a main body portion 24*a*. Integral with the main body portion is a narrow continuous gripping channel 25 which extends along side wall 24*b*, bottom 24*c* and remaining side wall 24*d*. The gripping channel 25, is defined by a flange integrally joined to the body portion and defined along the side wall 24*b* by downwardly directed portion 24*b*-1, center portion 24*b*-2 and upwardly directly portion 24*b*-3 whose extreme end extends diagonally outwardly at 24*b*-4. The gripping channel 25 along side wall 24*d* is similarly comprised of portions 24*d*-1 through 24*d*-4 which correspond to each of the portions 24*b*-1 through 24*b*-4 of side wall 24. Similarly, the gripping channel 25 along bottom edge 24*c* has a like configuration formed by portions 24*c*-1 through 24*c*-4 which correspond to portions 24*b*-1 through 24*b*-4, respectively.

The channel 25 of end cap 24 is designed to snap on to the open end of insert 20 to substantially firmly embrace the insert 20 and thereby completely seal the insert 20 on all six sides. The insert 20 with the end cap 24 mounted thereto is cast into the manhole top section by means of the mold assembly 30 shown best in FIGS. 6 and 6*a*. The mold assembly 30 is comprised of top and bottom flange rings 32 and 34 and inner and outer mold members 36 and 38. The inner and outer mold members 36, 38 are set upon bottom flange ring 34 which is utilized to form the bottom configuration 10*a* of the manhole top section as shown in FIG. 1. The top flange ring 32 and the top edge 36*a* of inner mold member 36 are each provided with four sets of positioning lugs arranged for example at 90 degree intervals along the imaginary radial lines R1 through R4 shown in FIG. 6*a*. The position lug assemblies each comprise a pair of L-shaped lugs 40*a*, 40*b* welded to the top surface 36 of inner mold member 36 to form receiving channels 42*a*, 42*b* for slideably receiving and holding the long sides of retaining slide 46 in the position shown in FIG. 8, as will be more fully described. A similar pair of L-shaped lugs 44*a* and 44*b* are welded to upper flange ring 32 in a similar manner for holding the long sides of the retaining slide 46 at the opposite end of retaining slide 46. Three more such L-shaped lug assemblies are arranged along the outer and inner mold members at the positions shown by radial lines R2 through R4 but have been omitted herein for purposes of simplicity.

The retaining slide member 46 is shown in greater detail in FIGS. 7 and 7*a* and is comprised of a substantially U-shaped metal handle having a gripping portion 46*a* and downwardly depending integral arms 46*b* and 46*c* welded at their bottom ends to a three sixteenth inch rectangular metal plate 48. A 26 guage metallic sheet 50 has its central portion 50*a* brazed to the under surface plate 48. The width of sheet 50 is greater than the width of plate 48 and the free ends are 50*b* and 50*c* are bent downwardly and then inwardly to form receiving channels 50*d* and 50*e* for receiving the outwardly directed flanges 20*b*-3 and 20*c*-3 of an insert 20 as is shown best in FIG. 8. If desired, the slide member 46 may be formed of a suitable plastic material.

The manner in which a manhole top section is cast is as follows:

The mold members 32, 34, 36, 38 which are utilized to form a manhole top section are assembled to form the mold assembly as shown in FIGS. 6 and 6*a*. Before end cap 24 is snapped to the open end of insert 20, square nut 23 is dropped into the insert so as to occupy the position shown in FIG. 3. The size of the nut 23 is such that its outer diameter is preferrably less than the width W across the base section of insert 20 as shown in FIG. 8 and is substantially greater than the width W1 between side wall portions 20*b*-2 and 20*c*-2, causing the nut to be captured within the base portion of insert 20 and so that the shoulders formed by side portions 20*b*-1 and 20*c*-1 prevent the nut from being moved out of the base portion of insert 20.

Although the nut 23 is prevented from moving upwardly, nut 23 is nevertheless free to be slideably moved along the entire length L (see FIG. 4*a*) of insert 20.

After nut 23 is dropped into insert 20, end cap 24 is snapped onto the open end of insert 20, sealing the insert on all sides. The insert 20, with the nut 23 and end cap 24 in place, is then positioned in the hollow region between the inner and outer mold members and adjacent to the upper ends thereof so as to be generally in alignment with the two pairs of lugs 40*a*, 40*b* and 44*a*, 44*b*. The retaining handle is then moved into place so that its long sides on opposite sides of handle 46*a* enter into the channels 42*a*, 42*b* formed by lugs 40*a*, 40*b* and the top surface 36*a* of mold member 36 and enter into similar channels formed between the lugs 44*a*, 44*b* and the top surface of flange ring 32. The retaining slide member 46 is moved into the aforementioned position while holding flanges 20*b*-3 and 20*c*-3 in the position shown in FIG. 8 so that flanges 20*b*-3 and 20*c*-3 enter into the channel regions 50*d* and 50*c* (see FIG. 7*a*) of the retaining slide assembly 46. The length of insert 20, including end cap 24, is preferably just slightly less than the radial dis tance D (see FIG. 6*a*) between the outer surface of mold member 36 and the inner surface of mold member 38.

All four insert assemblies 20 and retaining slide assemblies 46 are positioned at each of the radial locations previously mentioned. Although the preferred embodiment describes the use of four such arrangements, a greater or lesser number may be provided.

After the inserts 20 and retaining slide members 46 are installed in the manner described, the concrete is poured into the hollow interior region 52 between the inner and outer mold members (see FIG. 6*a*) filling the mold assembly to the top. After the concrete has cured, each retaining slide member 46 is moved either radially inwardly or radially outwardly in order to remove the retaining slide members 46 from the mold assembly. The inserts 20 are retained in position by the cured concrete which, in the wet state, follows the exterior contour of each insert 20 and, once cured, substantially exactly conforms to the exterior contour and shape of each insert 20, preventing the inserts from being removed from the cast top section 10. End cap 24 and top web 20*e* prevent concrete from entering into the interior of the inserts 20.

The top section 10 is then removed from the inner and outer mold assemblies and is now ready for installation and use at a job site.

The manner of use of the manhole top section 10 is as follows:

The top section 10 shown in FIG. 1 is placed upon a riser section having a top surface which conforms to the bottom end 10*a* of top section 10, assuring interlocking between the two members.

In the event that the ring shaped cast iron frame 54 (see FIG. 1) which supports manhole cover 56 is not sufficiently up to grade level, annular adjustment rings 58 may be positioned upon the top surface of top section 10. One more of these rings may be provided. The rings 58 are provided with over sized openings 58*a* for receiving the threaded rods 26.

Once the number of adjustment rings necessary to bring the cast iron frame 54 up to grade level are placed upon top section 10, the thin web 20*e* is pierced to gain access to the interior of the insert 20. The web is preferably made sufficiently thin to allow easy removal thereof through the use of a small knife or other suitable sharp pointed instrument, for example. The web 20*e*, in addition to preventing concrete from entering into insert 20, also maintains the structural integrity of the upper end of insert 20 during the molding operation by preventing the concrete from causing the insert 20 to yield or collapse as the concrete is poured around the insert.

After web 20*e* is cut away, a threaded rod 26 is inserted through the now open upper end of insert 20 and downwardly toward the base portion containing nut 23. The bottom end of threaded rod 26 is aligned with nut 23 and is inserted into nut 23 and rotated to secure threaded rod 26 to nut 23. Preferably, two parallel sides of the nut 23 engage the interior surfaces of side walls 20*b* and 20*c* to prevent nut 23, which is preferrably a square nut, from turning as threaded rod 26 is rotated. The threaded rod 26 is chosen to be of a length sufficient to extend from the lower end of insert 20 which receives nut 23 upward through the length of insert 20 and the thickness (or thicknesses) of the adjustment ring (or rings) 58 as well as the thickness of the outer radial flange 54*a* of cast iron frame 54 to extend beyond the upper surface of flange 54*a*. The cast iron frame 54 is placed upon either the top of insert 10 or the top of the top most adjustment ring 58 (if adjustment rings are used) and in alignment with the threaded rods such as for example threaded rod 26 shown in FIG. 1. The cast iron frame 54 is then dropped into place with threaded rod 26 extending through bolt hole 54*b*. Thereafter a fastening nut 58 is threaded to the top end of threaded rod 26 and is tightened sufficiently to form a water tight securement between cast iron frame 54 and manhole top section 10. A gasket (not shown) or other suitable means may be provided to effect the water-tight seal. The manhole cover 56 rests upon an internal shoulder 54*c* of cast iron frame 54 and may be lifted off as needed in order to gain access to the manhole assembly.

The length L of the insert is sufficient to accomodate the cast iron frames of either 24 or 32 inch diameter, for example, as well as accomodating cast iron frames whose bolt hole centers are displaced from an ideal imaginary circle. In the preferred embodiment, for example, the insert 20 may have a length of the order of 6 inches, although inserts of greater or lesser length may be utilized commensurate with the distance D between mold members 36 and 38.

As an alternative to the fastener embodiment described hereinabove employing a nut 23 and threaded rod 26, a T-shaped threaded assembly 60 as shown in FIG. 3*a* may be utilized. The assembly is comprised of an elongated threaded rod 62 whose bottom end is welded to a rectangular-shaped block or head 64 whose length L2 is substantially greater than the width W at the base of insert 20 (see FIG. 8) and whose width W2 is slightly less than the width W1 of insert 20.

T-shaped member 60 is utilized in the following manner:

When employing the T-shaped member 60 of FIG. 3*a*, the end cap 24 is snapped on to the end of insert 20 without insert ing a nut. The insert is then mounted in the molding assembly as before. After the molding operation is completed in the manner described hereinabove, and once the concrete has cured, and the manhole top section 10 has been installed at a job site, at least a portion of web 20*e* is removed and the head 64 of T-shaped assembly 60 is inserted through the opening formed by removal of web 20*e* with the orientation of assembly 60 as shown in FIG. 4*c*. Once head 64 has been lowered into the base portion of insert 20 the threaded portion 62 is rotated clockwise as shown by arrow 66 so that head 64 is rotated to occupy the dotted line position $64^1$ with a significant portion of the head 64 being captured by the shoulders formed by side wall portions 20*b*-1 and 20*c*-1 of insert 20 (see FIG. 8).

The T shaped assembly 60 may be moved either toward the left or toward the right along insert 20 to line up with a bolt hole in cast iron frame 54. The T shaped assembly 60 is mounted within insert 20 in such a manner that, when fastening nut 58 is tightened, any movement which nut 58 imparts to threaded member 62 will be in the direction of arrow 66 to prevent head 64 from moving free of the insert shoulders embracing the top edges of head 64.

The insert 20 is preferably formed of a suitable plastic material which lends itself readily to a molding operation. The preferred materials include polypropylene or PVC, although any other material exhibiting similar characteristics may be utilized, if desired.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. Molding apparatus for providing an elongated bolt slot in a manhole top section for accomodating manhole cover frames of varying diameter said molding apparatus including:

a mold assembly comprising inner and outer mold members which collectively form a hollow interior region defining the shape of the manhole top section;

channel forming lugs being arranged at spaced intervals about the top end of said mold members and providing receiving channels for a retaining slide member having a main body portion whose long sides are received by the aforesaid channels and being provided with first and second elongated flange receiving channels arranged along the long sides of said member with the open ends of said channels facing one another;

the channels of said retaining slide members slideably receiving the flanges of an insert comprising a hollow, elongated fully enclosed member having an interior of substantially T-shaped cross-section transverse to its length;

said flanges of said insert being a pair of outwardly directed flanges arranged along the long sides of said elongated insert for slideable insertion into the flange receiving channels of said retaining slide member for holding the insert in position within the hollow interior of said mold assembly during the casting of said manhole top section;

said slideable member being slideably removed from said channel forming lugs to release said insert flanges from said flange receiving channels after the top section has been cast and cured.

2. The apparatus of claim 1 wherein the top surface of said insert is formed of a web which is sufficiently thin to facilitate the cutting away and removal of said web to facilitate insertion of a threaded member into the interior of said insert.

3. The apparatus of claim 2 wherein one end wall of said insert is closed with an end cap having a shape conforming to said cross-sectional configuration and being provided with a continuous gripping channel which receives the open end of the insert.

4. The apparatus of claim 3 further comprising a nut inserted into the base portion of said insert and slideable along the length of said base portion.

5. The apparatus of claim 4 wherein one end of said threaded member threadedly engages said nut.

6. The apparatus of claim 5 wherein the opposite end of said threaded member is threaded for threaded engagement with a threaded fastening member.

7. A method for producing manhold top sections to facilitate the threaded fastening of a cover frame thereto comprising the steps of:

providing a mold assembly having a hollow interior defining the shape of the manhole top section to be cast;

providing an elongated insert having a hollow interior of a substantially T-shaped cross-sectional configuration which cross sectional configuration is substantially uniform over the length of said insert;

said mold assembly having channel forming members along the top end thereof;

slideably inserting a slidable insert positioning member into the channels of said channel forming members for supporting said slideable member along the top of said mold assembly and extending between said inner and outer mold members;

said slideable member having a pair of flange receiving channels for slideably receiving the flanges provided along the upper end of said insert;

holding an insert in the hollow interior region near the top of said mold assembly and adjacent said channel forming members;

sliding said slideable member into the channels formed by said channel forming member and so that the flanges of said insert are slideably received by the flange receiving channels of said slideable member;

pouring the cast material into said mold to fill said mold and engage the bottom and sides of said insert so as to retain said insert within the manhole top section when the cast material has cured.

8. The method of claim 7 further comprising the step of inserting a nut into the base portion of said insert prior to placement of said insert into the upper hollow region of said mold assembly.

9. The method of claim 7 further comprising the step of sliding the slideable member out of the channel forming members after said material has been cast to facilitate removal of the manhole top section from the molding assembly.

10. The method of claim 7 further comprising the step of cutting away at least a portion of the web of said insert and inserting the head of a T-shaped member having a threaded rod secured to said head;

rotating said T-shaped member about its longitudinal axis to wedge said head into the enlarged base portion of the insert for securement of said T-shaped member in said insert.

11. The method of claim 10 wherein said T-shaped member has a substantially rectangular shaped head portion which has a length greater than the width of the base of said insert and a width less than the upper portion of said insert whereby the T-shaped member is aligned at a first angular orientation for insertion into the insert and is then rotated about its longitudinal axis through a maximal angle of no greater than 90 degrees to lock said T-shaped member within said insert.

12. The method of claim 7 further comprising the steps of removing the removable end cap of the insert;

inserting a threaded nut into the base portion of the insert;

replacing the end cap on said insert prior to insertion of the insert into the mold assembly.

13. The method of claim 12 further comprising the step of cutting away a portion of the top surface of the insert;

inserting a threaded rod into the insert through the opening formed by the cut away portion;

and inserting one end of the threaded rod into mid threaded nut.

* * * * *

UNITED STATES PATENT AND TRADEMARK OFFICE

CERTIFICATE OF CORRECTION

PATENT NO. : 4,618,464

DATED : October 21, 1986

INVENTOR(S) : JACK DITCHER

It is certified that error appears in the above-identified patent and that said Letters Patent is hereby corrected as shown below:

Column 8, line 32, change "manhold" to --manhole--.

Column 10, line 16, change "mid" to --said--.

Signed and Sealed this

Thirty-first Day of March, 1987

*Attest:*

DONALD J. QUIGG

*Attesting Officer*

*Commissioner of Patents and Trademarks*